US009299511B2

(12) United States Patent
Yeh et al.

(10) Patent No.: US 9,299,511 B2
(45) Date of Patent: Mar. 29, 2016

(54) KEY ASSEMBLY AND ELECTRONIC DEVICE

(71) Applicant: HTC Corporation, Taoyuan County (TW)

(72) Inventors: Han-Wen Yeh, Taoyuan County (TW); I-Cheng Chuang, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 55 days.

(21) Appl. No.: 14/290,993

(22) Filed: May 30, 2014

(65) Prior Publication Data

US 2015/0348724 A1 Dec. 3, 2015

(51) Int. Cl.
*H01H 13/14* (2006.01)
*H01H 13/06* (2006.01)
*H01H 13/10* (2006.01)

(52) U.S. Cl.
CPC ..... *H01H 13/14* (2013.01); *H01H 13/06* (2013.01); *H01H 13/10* (2013.01); *H01H 2203/00* (2013.01); *H01H 2211/00* (2013.01); *H01H 2221/03* (2013.01); *H01H 2221/044* (2013.01); *H01H 2223/002* (2013.01)

(58) Field of Classification Search
CPC ..... H01H 13/06; H01H 3/02; H01H 13/14
USPC ..... 200/16 R, 302.2–302.3, 341, 520, 530
See application file for complete search history.

(56) References Cited

U.S. PATENT DOCUMENTS 4,007,347 A * 2/1977 Haber ..... G04C 3/005 200/52 R
6,570,105 B1 * 5/2003 Sallam ..... H01H 25/06 200/1 R
6,642,920 B2 11/2003 Osawa et al.
6,717,082 B1 4/2004 Wu
6,910,439 B2 * 6/2005 Baba ..... B60K 37/02 116/62.1

FOREIGN PATENT DOCUMENTS

| | | |
|---|---|---|
| CN | 102543497 | 7/2012 |
| JP | H08273477 | 10/1996 |
| TW | M359055 | 6/2009 |
| TW | 201137909 | 11/2011 |

OTHER PUBLICATIONS

"Notice of Allowance of Taiwan Counterpart Application", issued on Apr. 14, 2015, p. 1-p. 3.

* cited by examiner

*Primary Examiner* — Edwin A. Leon
*Assistant Examiner* — Iman Malakooti
(74) *Attorney, Agent, or Firm* — Jianq Chyun IP Office

(57) ABSTRACT

A key assembly and electronic device is provided. The key assembly is disposed at a housing of the electronic device. The key assembly includes a circuit board, a shaft, a limiting portion, a contact element and an elastic element. The circuit board disposed in the housing has a first contact and a second contact. The shaft penetrates through the housing and the circuit board and having a first end and a second end. The limiting portion is located at the second end of the shaft. The contact element is located between the housing and the circuit board. The elastic element is coupled between the shaft and the circuit board. When the shaft drives the contact element to move toward the circuit board for the contact element to contact the second contact, the second contact is electrically connected to the first contact through the contact element to generate an electrical signal.

20 Claims, 5 Drawing Sheets

KEY ASSEMBLY AND ELECTRONIC DEVICE

BACKGROUND

1. Technical Field

The application relates to a key assembly, and more particularly to an electronic device using the key assembly.

2. Description of Related Art

Recent years, technology products mostly set mobility and functionality as their main goal. Accordingly, portable electronic devices such as smart phones, tablet PCs and notebook PCs, etc. have become the mainstream products in the market of electronic devices.

In general, a portable electronic device is usually equipped with a key on the housing thereof, and a switch component corresponding to the key is disposed in the housing. The key and the switch component are coupled to each other, such that a user may control the switch component by pressing the key, so as to control switch such as power, Bluetooth or wireless network switch, or control function such as volume adjusting, images recording or display pages scrolling up and down, etc. In general, the housing of the portable electronic device has to be equipped with the corresponding opening to dispose the switch component for convenience in use. However, an overall size of the conventional switch component is rather large, and in order to let the switch component be contained in the abovementioned opening or let a part of switch component pass through the abovementioned opening, the size of the abovementioned opening cannot be effectively reduced. Accordingly, dust and moisture may easily enter the electronic device through the gap between the switch component and abovementioned opening, so as to affect the function of the electronic device, and even shorten the life span of the electronic device. Moreover, it is hard to meet the requirements in miniature design for portable electronic devices.

SUMMARY

The application provides a key assembly, which meets the requirements in miniature design.

The application provides an electronic device, which adopts the abovementioned key assembly to save the inner space for disposition, so as to meet the requirements in miniature design.

The application provides a key assembly, disposed at a housing of an electronic device. The housing has a first through hole. The key assembly includes a circuit board, a shaft, a limiting portion, a contact element and an elastic element. The circuit board is disposed on an inner side of the housing, wherein the circuit board has a second through hole, a first contact and a second contact. The shaft has a first end and a second end opposite to the first end. The shaft passes through the first through hole and the second through hole. The first end protrudes from an outer side of the housing, and the second end protrudes from the circuit board. The limiting portion is located at the second end of the shaft, so that the second end protrudes from the circuit board. The contact element is located between the housing and the circuit board and disposed on the shaft. The elastic element is coupled between the shaft and the circuit board. When the shaft drives the contact element to move toward the circuit board for the contact element to contact the second contact, the elastic element stores an elastic potential and the contact element is electrically connected to the first contact such that the second contact is electrically connected to the first contact through the contact element to generate an electrical signal.

The application further provides an electronic device which includes a body, a housing and a key assembly. The housing covers the body and has a first through hole. The key assembly is disposed at the housing. The key assembly includes a circuit board, a shaft, a limiting portion, a contact element and an elastic element. The circuit board is disposed on an inner side of the housing and has a second through hole. The circuit board has a first contact and a second contact. The shaft has a first end and a second end opposite to the first end. The shaft passes through the first through hole and the second through hole. The first end protrudes from an outer side of the housing, and the second end protrudes from the circuit board. The limiting portion is located at the second end of the shaft, so that the second end protrudes from the circuit board. The contact element is located between the housing and the circuit board and disposed on the shaft. The elastic element is coupled between the shaft and the circuit board. When the shaft drives the contact element to move toward the circuit board for the contact element to contact the second contact, the elastic element stores an elastic potential, and the contact element is electrically connected to the first contact such that the second contact is electrically connected to the first contact through the contact element to generate an electrical signal.

In light of the foregoing, the application provides a key assembly and an electronic device using the key assembly, wherein the shaft of the key assembly passes through the first through hole of the housing, such that the components such as the limiting portion, the contact element and the elastic element thereof are disposed in the housing so as to reduce the size of the first through hole. Accordingly, not only the requirement in miniature design of the electronic device can be met, but the possibility of moisture or dust from external environment entering the electronic device through the first through hole can also be reduce, so as to improve the life span and the reliability of the electronic device.

To be specific, the shaft passes through the second through hole of the circuit board at the same time. The contact element is located between the housing and the circuit board and clamps the shaft, and the elastic element is coupled between the shaft and the circuit board. When a user presses the part of the shaft protruding from the outer side of the housing, the shaft drives the contact element to move toward the circuit board, such that the contact element contacts the second contact of the circuit board. At the time, the second contact of the circuit board is electrically connected to the first contact of the circuit board through the contact element to generate an electrical signal, so as to actuate the corresponding control functions of the electronic device. Due to the key assembly of the application being highly integrated, an overall volume of the key assembly is effectively reduced, such that the electronic device using the abovementioned key assembly can achieve the goal of saving inner space for disposition, so as to meet the requirement in miniature design.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the application.

DESCRIPTION OF EMBODIMENTS

Figure 1:
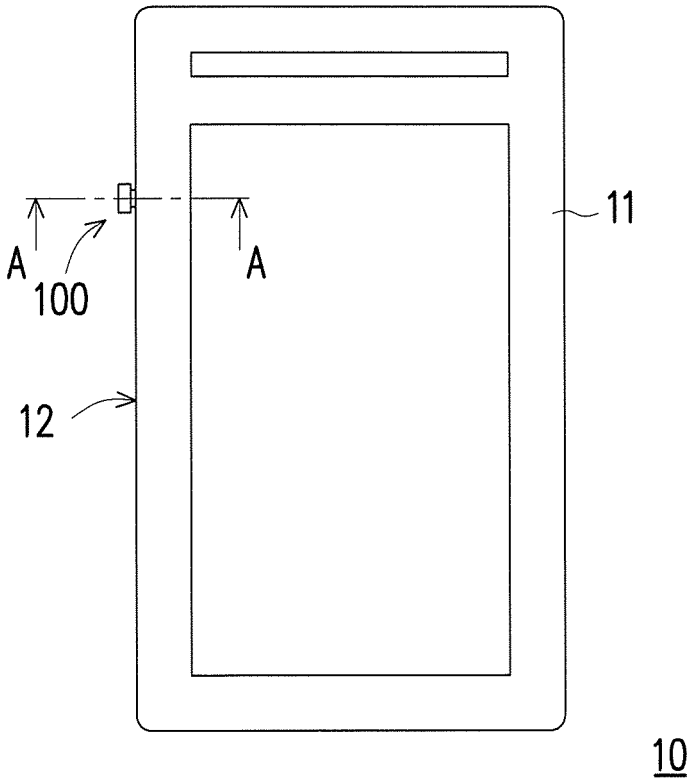
FIG. 1 is a schematic view illustrating an electronic device according to an embodiment of the application.
Figure 2:
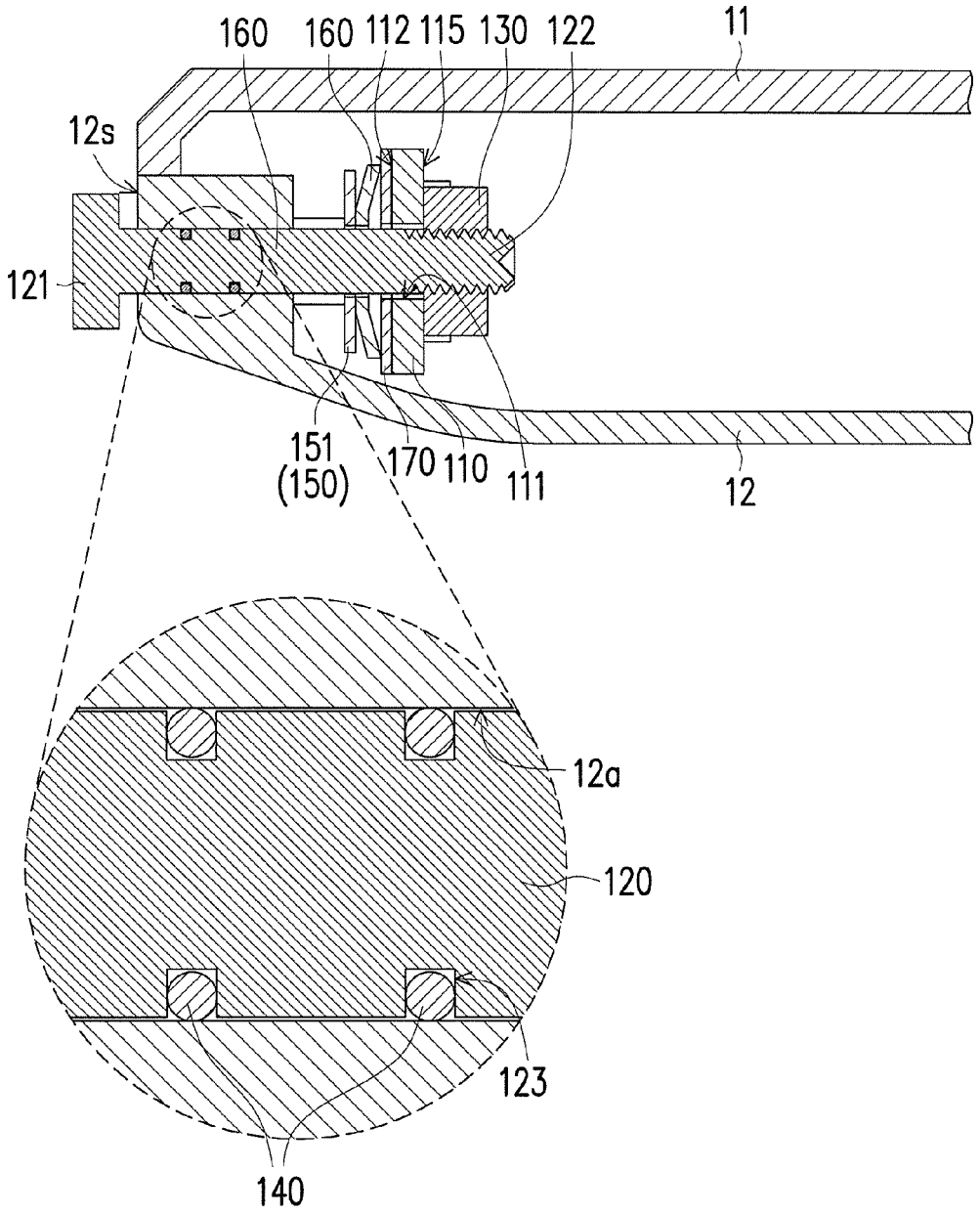
FIG. 2 is a cross-sectional view of the electronic device depicted in FIG. 1 along a sectional line A-A.
Figure 3:
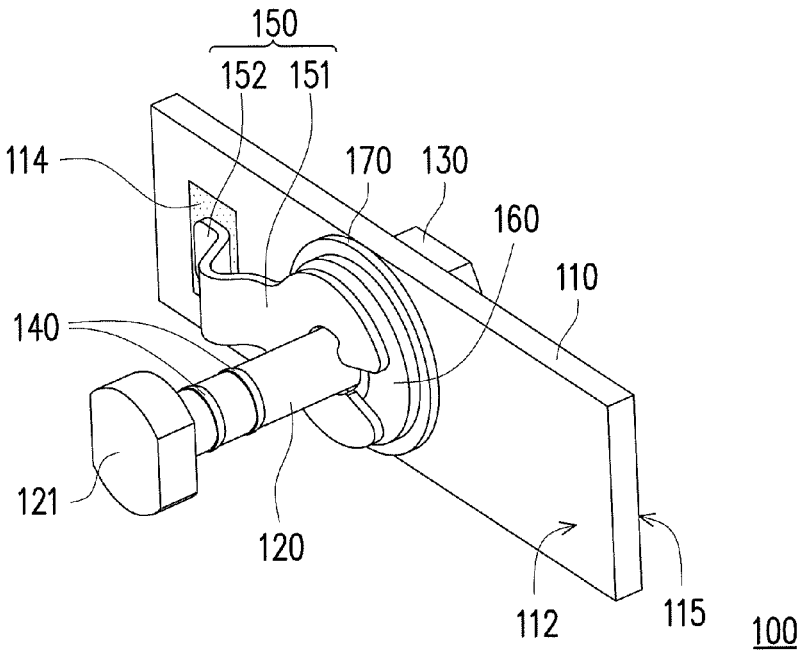
FIG. 3 is a schematic view of a key assembly depicted in FIG. 1.

FIG. 1 is a schematic view illustrating an electronic device according to an embodiment of the application. FIG. 2 is a cross-sectional view of the electronic device depicted in FIG. 1 along a sectional line A-A. FIG. 3 is a schematic view of a key assembly depicted in FIG. 1. For clearer illustration, it is noted that a part of the components disposed in the housing 12 are not depicted in FIG. 2. Referring to FIG. 1 to FIG. 3, in the present embodiment, the electronic device 10 includes a body 11, a housing 12 and a key assembly 100. The housing 12 covers the body 11 and has a first through hole 12*a*, and the key assembly 100 is disposed at the housing 12. The electronic device 10 may be, for example, a mobile phone, a smart phone or a tablet PC, etc., and the housing 12 may be, for example, a plastic housing, a carbon-fiber housing or a complex housing composed of plastic and metal. Herein, the amount of the first through hole 12*a* may be, for example, one, and the first through hole 12*a* is located on a side wall 12*s* of the housing, but the application does not limit the location of the first through hole 12*a* on the housing 12, and also not limit the amount of the first through hole 12*a*. They can be adjusted according to actual demands in design.

The following is a description directed towards the detailed structures of the key assembly 100. In the present embodiment, the key assembly 100 is disposed at the housing 12, and includes a circuit board 110, a shaft 120, a limiting portion 130, a seal element 140, a contact element 150 and an elastic element 160. The circuit board 110 is disposed at an inner side of the housing 12 and has a second through hole 111. In general, the circuit board 110 may be an inflexible printed circuit board or a complex circuit board, and the second through hole 111 may be formed on the circuit board 110 by processes such as etching or drilling, etc. The application is not limited thereto.

Figure 4:
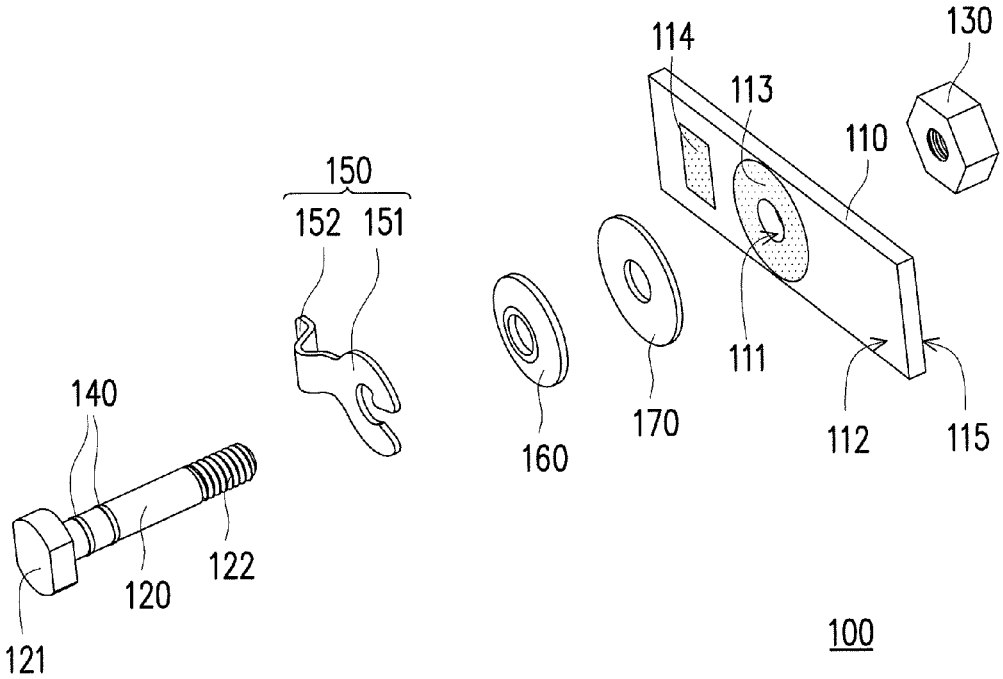
FIG. 4 is an exploded view of the key assembly depicted in FIG. 3.

FIG. 4 is an exploded view of the key assembly depicted in FIG. 3. Referring to FIG. 2 to FIG. 4, the circuit board 100 further has a first surface 112 facing the housing 12, and a first contact 113 and a second contact 114 located on the first surface 112. To be more specific, the second through hole 111 substantially corresponds to the location of the first through hole 112*a*, and the first contact 113 is, for example, a circular pattern surrounding the second through hole 111, and the second contact 114 is, for example, a rectangular pattern, but the application is not limited thereto. The types of the patterns of the first contact 113 and the second contact 114 can be modified according to actual demands in design. In general, the first contact 113 and the second contact 114 are, for example, a circuit pattern formed on the circuit board 110 by electroplating, halftone printing or spray printing, etc., and the material may be metal with high conductivity such as copper, gold, silver or nickel, etc. Even though the first contact 113 and the second contact 114 disposed on the same surface (i.e. first surface 112) are illustrated herein, but the application is not limited thereto. Therefore, in other embodiment, the first contact 113 and the second contact 114 may be disposed on different surfaces on the circuit board 110 respectively.

The shaft 120 passes through the first through hole 12*a* and the second through hole 111 respectively, and has a first end 121 and a second end 122 opposite to the first end 121. The first end 121 protrudes from an outer side of the housing 12 to function as a key for a user to press. The second end 122 protrudes from a second surface 115 of the circuit board 110, wherein the second surface 115 is opposite to the first surface 112. The limiting portion 130 is located at the second end 122 of the shaft 120, and a size of the limiting portion 130 is greater than a size of the second through hole 111, such that the second end 122 can be limited at a side of the circuit board 110 opposite to the second contact 114, i.e. the side where the second surface 115 is located. In general, the limiting portion 130 is, for example, a screw nut locking to the second end 122 of the shaft 120, or a limiting structure integrally formed with the second end 122 of the shaft 120. The application is not limited thereto.

Comparing to conventional opening for containing the whole switch component in prior art, the size of the first through hole 12*a* can be effectively reduced since the first through hole 12*a* is merely configured for disposing shaft 120, such that the requirement in miniature design can be met, and the possibility of moisture or dust from external environment entering the electronic device 10 through the first through hole 12*a* can also be reduced, so as to improve the life span and the reliability of the electronic device 10.

Due to the size of the limiting portion 130 being greater than the size of the second through hole 111, when the shaft 120 move toward outside from the housing 12, the limiting portion 130 structurally interferes with the circuit board 110, so that the second end 122 of the shaft 120 always protrudes from the second surface 115, and prevents the shaft 120 from falling out of the housing 12 through the first through hole 12*a* after the shaft 120 and the circuit board 110 are separated.

The seal element 140 is disposed between the shaft 120 and an inner wall of the first through hole 12*a*, wherein the seal element 140 may be an O ring, but the application is not limited thereto. To be more specific, a groove 120 containing the O ring is disposed around an outer circumferential surface of the shaft 120, such that the O ring can be limited in the groove 123 after being disposed on the shaft 120, and would not be separated from the shaft 120 easily. Moreover, the O ring leans against the inner wall of the first through hole 12*a*, so moisture or dust from external environment can be blocked by the O ring, such that the life span and the reliability of the electronic device can be improved.

The contact element 150 is located between the housing 12 and the circuit board 110, and the material may be metal with high conductivity such as copper, gold, silver or nickel, etc. In the present embodiment, the contact element 150 has a fix end 151 fixed to the shaft 120 and a free end 152 opposite to the fix end 151, wherein the fix end 151 is, for example, a C-type retaining ring, such that the contact element 150 can clamp the shaft 120 by the C-type retaining ring. On the other hand, the free end 152 corresponds to the location of the second contact 114, and the elastic element 160 is coupled between the shaft 120 and the circuit board 110. Herein, the elastic element 160 is, for example, a conductive spring washer disposed between the fix end 151 of the contact element 150 and the first contact 113 of the circuit board 110, and the shaft 120 passes through the spring washer.

On the other hand, the key assembly 100 further includes a spacer 170. The spacer 170 is disposed between the spring washer and the first contact 113 of the circuit board 110. The fix end 151 of the contact element 150, the elastic element 160 and the spacer 170 are electrically connected to each other, and the spacer 170 is electrically connected to the first contact 113. That is to say, in the present embodiment, the contact element 150 and the first contact 113 are electrically connected to each other by, for example, the elastic element 160 respectively leaning against the fix end 151 of the contact element 150 and the spacer 170, and the spacer 170 contacting the first contact 113. Herein, the shaft 120 can be made of non-conductive material such as plastic, acrylic or other suitable material, and the contact element 150 may, at first, not lean against the elastic element 160, but may be electrically connected to the first contact 113 when the shaft 120 drives the contact element 150 to move toward the circuit board 110 to lean against the elastic element 160, however, the application is not limited thereto. Herein, the elastic element 160 is illustrated as above as a spring washer, so as to achieve the purpose of saving the inner space of the electronic device 10 for disposition, and meet the demands in miniature design, but the application is not limited thereto. In other embodiments, the elastic component 160 may also be a compressive spring or other suitable elastic structure. Under a condition of the spacer 170 not being disposed, the elastic element 160 may also lean against the first contact 113 and the contact element 150 respectively, such that the first contact 113 and the contact element 150 are electrically connected to each other.

Even though the shaft 120 in the abovementioned embodiment is illustrated as being made of non-conductive material, in other embodiments, however, the shaft 120 may also be made of conductive material such as metal. Namely, the contact element 150 may be electrically connected to the first contact 113 through the conductive shaft 120 and the elastic element 160. At the time, the fix end 151 of the contact element 150 may or may not lean against the elastic element 160. The application is not limited thereto. For example, under a condition of the fix end 151 of the contact element 150 not leaning against the elastic element 160, the conductive path between the contact element 150 and the first contact 113 is, for example, the contact element 150—conductive shaft 120—elastic element 160—spacer 170—first contact 113, wherein it can be chosen to not dispose the spacer 170 and let the elastic element 160 lean against the first contact 113 instead.

Figure 5:
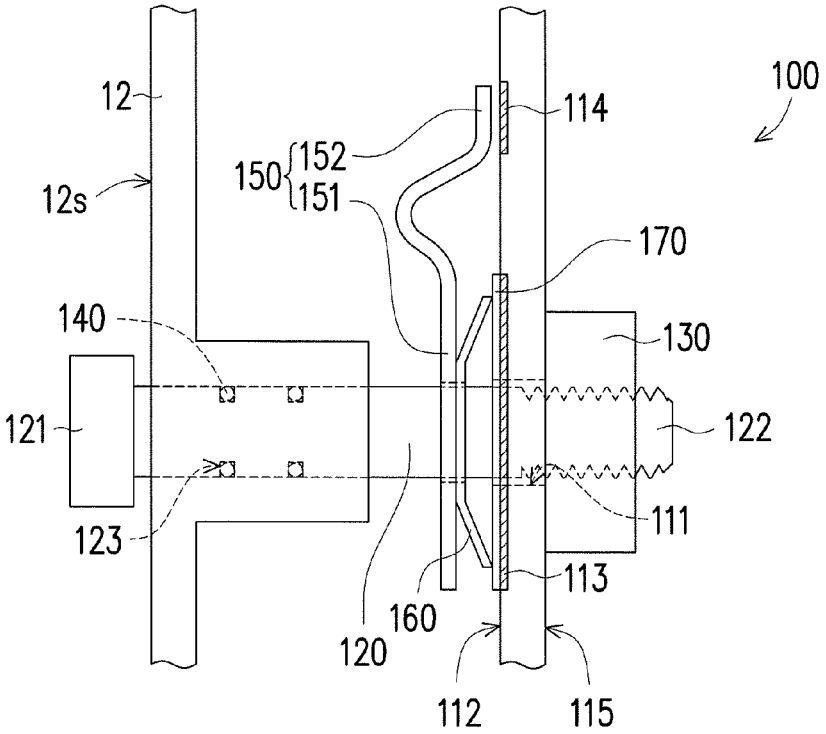
FIG. 5 is a partial perspective view of the location of the key assembly of the electronic device in FIG. 1.
Figure 6:
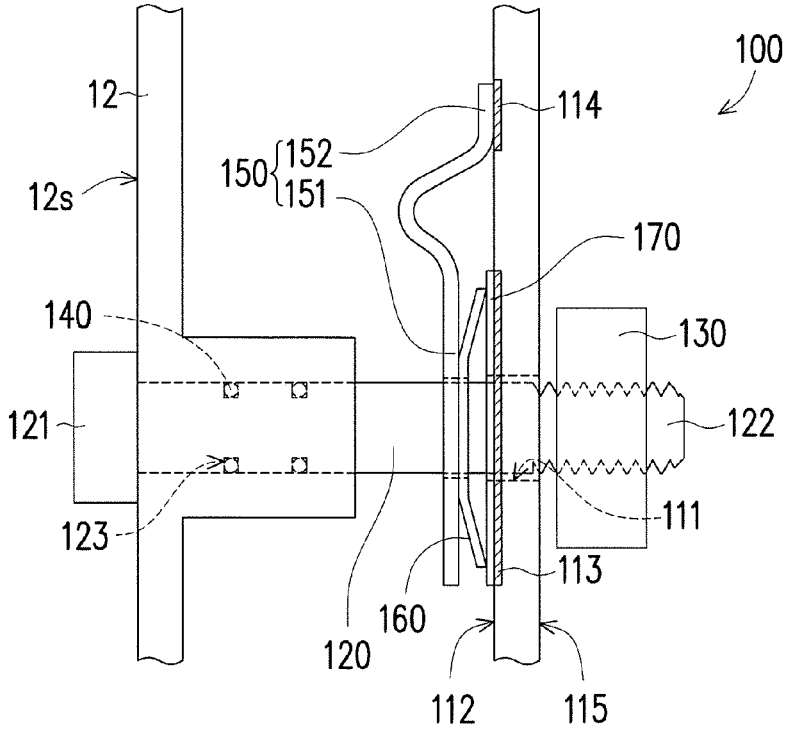
FIG. 6 is a schematic view of the key assembly depicted in FIG. 5 after operation.

FIG. 5 is a partial perspective view of the location of the key assembly of the electronic device in FIG. 1. FIG. 6 is a schematic view of the key assembly depicted in FIG. 5 after operation. Referring to FIG. 5 and FIG. 6, when the shaft 120 drives the contact element 150 to move toward the circuit board 110 for the free end 152 of the contact element 150 to contact the second contact 114, the elastic element 160 is pushed by the fix end 151 of the contact element 150 and deformed, so as to store an elastic potential. Since the deformed elastic element 160 still respectively leans against the fix end 151 of the contact element 150 and the spacer 170, the second contact 114 can still be electrically connected to the first contact 113 through the contact element 150. Herein, the conductive path of the first contact 113 and the contact element 150 is illustrated as the elastic element 160 respectively leaning against the fix end 151 of the contact element 150 and the spacer 170, and the spacer 170 contacting the first contact 113. At the time, the shaft 120 can be made of non-conductive material such as plastic, acrylic or other suitable material, but the application is not limited thereto.

After the second contact 114 is electrically connected to the first contact 113 through the contact element 150, the elastic element 160 and the spacer 170, an electrical signal is generated, and the second contact 114, the contact element 150, the elastic element 160, the spacer 170 and the first contact 113 which are electrically connected to each other can form an electrical loop. The abovementioned electrical signal may further transmit to the body 11 since the circuit board 110 and the body 11 are electrically connected to each other, such that the corresponding process unit (not shown) in the body 11 can generate a control signal according to the electrical signal, and the control signal may be, for example, power switch signal, volume adjustment signal or image scrolling signal, etc. After an electronic component (not shown) of the electronic device 10 receive the control signal described above, the electronic component (not shown) can be driven to execute the corresponding functions such as switching power on and off, turning volume up and down or scrolling images on display up and down, etc.

Next, when an external force applied on the first end 121 of the shaft 120 is removed, the elastic potential stored by the deformed elastic element 160 is released, so as to drive the elastic element 160 to restore to the initial status shown in FIG. 5. At the time, the contact element 150 is pushed by the elastic element 160 to move along the direction away form the circuit board 110, such that the free end 152 and the second contact 114 are separated from each other. At the time, a gap remains between the first end 121 and the housing 12 for the user to operate later on. Specifically, under the condition of the second contact 114 electrically connected to the first contact 113 without the help of the contact element 150, the elastic element 160 and the spacer 170, the abovementioned electrical signal is not generated and the abovementioned electrical loop is disconnected, so as to stop the electronic device 10 from executing the corresponding functions such as switching power on and off, turning volume up and down or scrolling images on display up and down, etc. When later the user presses the first end 121 of the shaft 120 to drive the contact element 150 to move toward the circuit board 110 for the free end 152 of the contact element 150 to contact the second contact 114, such that the second contact 114 is electrically connected to the first contact 113 through the contact element 150, elastic element 160 and spacer 170 to generate the electrical signal, the electronic device 10 can execute the corresponding functions again.

Figure 7:
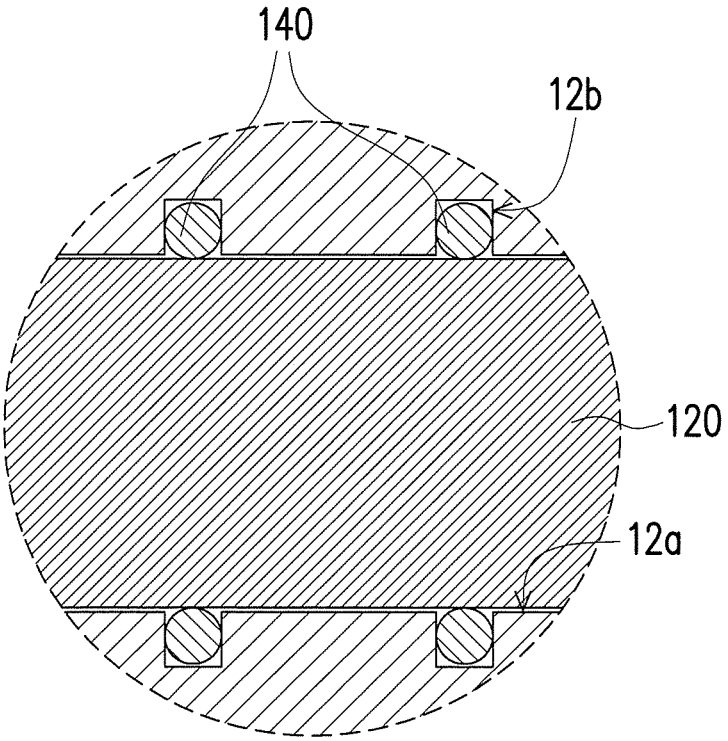
FIG. 7 is a partial cross-sectional view illustrating an electronic device according to another embodiment of the application.

FIG. 7 is a partial cross-sectional view illustrating an electronic device according to another embodiment of the application, wherein the cross section thereof is substantially the same with the partial enlarged section shown in FIG. 2. Referring to FIG. 7, the method of disposing the seal element 140 of the electronic device is slightly different from the seal element 140 of the embodiment described above, and the differences fall in: the seal element 140 of the electronic device in FIG. 7 is, for example, fixed on an inner wall of the first through hole 12*a*. For instance, the seal element 140 can be fixed in a groove 12*b* of the inner wall of the first through hole 12*a*, and the shaft 120 is limited to the groove 12*b* after being disposed in the first through hole 12*a*, so it does not separate from the groove 12*b* easily. Moreover, the seal element 140 leans against an outer circumferential surface of the shaft 120, so as to block moisture or dust from external environment by the seal element 140 and enhance the life span and reliability of the electronic device.

In sum, the application provides a key assembly and an electronic device using the same, wherein the shaft of the key assembly passes through the first through hole of the housing such that the components such as limiting portion, contact element and elastic element, etc. can be disposed in the housing, and the size of the first through hole can be reduced. Thereby, not only the demands in miniature design for the electronic device can be met, but the possibility of moisture or dust from external environment entering the electronic device can be reduced, so as to enhance the life span and reliability of the electronic device.

To be more specific, the shaft passes through the second through hole of the circuit board at the same time, the contact element is located between the housing and the circuit board and clamps the shaft, and the elastic element is coupled between the shaft and the circuit board. When the user presses a part of the shaft protruding from an outer side of the housing, the shaft drives the contact element to move toward the circuit board for the free end of the contact element to contact the second contact of the circuit board. At the time, the second contact of the circuit board is electrically connected to the first contact through the contact element to generate an electrical signal, so as to actuate the corresponding control functions of the electronic device. Due to the key assembly of the application being highly integrated, an overall volume can be effectively reduced, such that the electronic device using the abovementioned key assembly can achieve the goal of saving inner space for disposition, so as to meet the requirement in miniature design.

Although the application has been described with reference to the embodiments thereof, it will be apparent to one of the ordinary skills in the art that modifications to the described embodiments may be made without departing from the spirit of the application. Accordingly, the scope of the application will be defined by the attached claims not by the above detailed description.

What is claimed is:

1. A key assembly, disposed on a housing of an electronic device and the housing having a first through hole, the key assembly comprising:

a circuit board disposed at an inner side of the housing and having a second through hole, a first contact and a second contact;

a shaft having a first end and a second end opposite to the first end, the shaft passing through the first through hole and the second through hole, the first end protruding from an outer side of the housing and the second end protruding from the circuit board;

a limiting portion located at the second end of the shaft, so that the second end protrudes from the circuit board;

a contact element located between the housing and the circuit board, the contact element is disposed on the shaft; and an elastic element coupled between the shaft and the circuit board, wherein the elastic element and the contact element are two separate elements, the elastic element disposed between the contact element and the circuit board, when the shaft drives the contact element to move toward the circuit board for the contact element to contact the second contact, the elastic element stores an elastic potential, and the contact element is electrically connected to the first contact such that the second contact is electrically connected to the first contact through the contact element to generate an electrical signal.

2. The key assembly as claimed in claim 1, wherein the circuit board has a first surface facing the first through hole, and the first contact and the second contact are located on the first surface.

3. The key assembly as claimed in claim 1, further comprising:

a seal element, disposed between the shaft and an inner wall of the first through hole, wherein the seal element comprises an O ring.

4. The key assembly as claimed in claim 3, wherein the seal element is fixed on the shaft, a groove containing the seal element is disposed around an outer circumferential surface of the shaft.

5. The key assembly as claimed in claim 1, wherein a size of the limiting portion is greater than a size of the second through hole.

6. The key assembly as claimed in claim 3, wherein the seal element is fixed to an inner wall of the first through hole, a groove containing the seal element is disposed around an inner surface of the inner wall.

7. The key assembly as claimed in claim 1, wherein the contact element has a fix end fixed to the shaft and a free end opposite to the fix end, and when the shaft drives the contact element to move toward the circuit board, the free end contacts the second contact.

8. The key assembly as claimed in claim 7, wherein the fix end of the contact element comprises a C-type remaining ring, the C-type remaining ring clamps the shaft.

9. The key assembly as claimed in claim 1, wherein the elastic element is a spring washer, disposed between the contact element and the circuit board, and the shaft passes through the spring washer.

10. The key assembly as claimed in claim 9, further comprising:

a spacer disposed between the spring washer and the first contact of the circuit board and electrically connected to the contact element and the first contact.

11. An electronic device, comprising:

a body;

a housing covering the body and having a first through hole; and a key assembly disposed at the housing, the key assembly comprising:

a circuit board disposed at an inner side of the housing and having a second through hole, a first contact and a second contact;

a shaft having a first end and a second end opposite to the first end, the shaft passing through the first through hole and the second through hole, the first end protruding from an outer side of the housing and the second end protruding from the circuit board;

a limiting portion located at the second end of the shaft, so that the second end protrudes from the circuit board;

a contact element located between the housing and the circuit board, the contact element is disposed on the shaft; and an elastic element coupled between the shaft and the circuit board, wherein the elastic element and the contact element are two separate elements, and the elastic element disposed between the contact element and the circuit board, when the shaft drives the contact element to move toward the circuit board for the contact element to contact the second contact, the elastic element stores an elastic potential, and the contact element is electrically connected to the first contact such that the second contact is electrically connected to the first contact through the contact element to generate an electrical signal.

12. The electronic device as claimed in claim 11, wherein the circuit board has a first surface facing the first through hole, and the first contact and the second contact are located on the first surface.

13. The electronic device as claimed in claim 11, wherein the key assembly comprises:

a seal element disposed between the shaft and an inner wall of the first through hole, wherein the seal element comprises an O ring.

14. The electronic device as claimed in claim 13, wherein the seal element is fixed on the shaft, a groove containing the seal element is disposed around an outer circumferential surface of the shaft.

15. The electronic device as claimed in claim 11, wherein a size of the limiting portion is greater than a size of the second through hole.

16. The electronic device as claimed in claim 13, wherein the seal element is fixed to the inner wall of the first through hole, a groove containing the seal element is disposed around an inner surface of the inner wall.

17. The electronic device as claimed in claim 11, wherein the contact element has a fix end fixed to the shaft and a free end opposite to the fix end, and when the shaft drives the contact element to move toward the circuit board, the free end contacts the second contact.

18. The electronic device as claimed in claim 17, wherein the fix end of the contact element comprises a C-type remaining ring and the C-type remaining ring clamps the shaft.

19. The electronic device as claimed in claim 11, wherein the elastic element is a spring washer, disposed between the contact element and the circuit board, and the shaft passes through the spring washer.

20. The electronic device as claimed in claim 19, wherein the key assembly further comprises:

a spacer disposed between the spring washer and the first contact of the circuit board, and electrically connected to the contact element and the first contact.

* * * * *